US008690139B2

(12) United States Patent
Sladojevic et al.

(10) Patent No.: US 8,690,139 B2
(45) Date of Patent: Apr. 8, 2014

(54) ADAPTER FOR A MAGNETIC CLAMP

(75) Inventors: Robert Sladojevic, Blackwood (AU); Steven Girotto, Blackwood (AU); Craig Deleon, Blackwood (AU)

(73) Assignee: SRB Construction Technologies Pty. Ltd., Blackwood (AU)

( * ) Notice: Subject to any disclaimer, the term of this patent is extended or adjusted under 35 U.S.C. 154(b) by 944 days.

(21) Appl. No.: 11/721,025

(22) PCT Filed: Dec. 14, 2005

(86) PCT No.: PCT/AU2005/001892

§ 371 (c)(1),
(2), (4) Date: Aug. 10, 2009

(87) PCT Pub. No.: WO2006/063399

PCT Pub. Date: Jun. 22, 2006

(65) Prior Publication Data

US 2009/0295055 A1 Dec. 3, 2009

(30) Foreign Application Priority Data

Dec. 16, 2004 (AU) ..... 2004907162

(51) Int. Cl.
*B25B 5/16* (2006.01)

(52) U.S. Cl.
USPC ..... 269/275; 269/271

(58) Field of Classification Search
USPC ..... 269/86, 134, 267, 56, 276, 19, 17, 8, 269/95, 316, 317, 257, 271, 275; 249/219.1, 1; 425/3; 238/315
See application file for complete search history.

(56) References Cited

U.S. PATENT DOCUMENTS

| | | | | |
|---|---|---|---|---|
| 3,730,657 | A | 5/1973 | Malet et al. | |
| D259,327 | S * | 5/1981 | Sloane | D8/72 |
| 6,305,615 | B1 * | 10/2001 | Traktovenko | 238/315 |
| 6,452,409 | B1 * | 9/2002 | Pursel | 324/757.02 |
| 6,547,209 | B1 | 4/2003 | Vappula | |

FOREIGN PATENT DOCUMENTS

| | | |
|---|---|---|
| DE | 296 07 438 U1 | 10/1997 |
| EP | 0945 238 A | 9/1999 |

OTHER PUBLICATIONS

Australian Examination Report issued Jan. 8, 2009 for counterpart Australian Application No. 2005316202.
European Search Report issued Mar. 11, 2010 for counterpart European Application No. 05815899.0.

* cited by examiner

*Primary Examiner* — Lee D Wilson
*Assistant Examiner* — Jamal Daniel
(74) *Attorney, Agent, or Firm* — Sughrue Mion, PLLC

(57) ABSTRACT

An adapter (10) for a magnetic clamp (12) includes a body (14) having an element engaging portion (16) for engaging an element (18) to be supported in position by the magnetic clamp (12). A height compensation mechanism (20) is carried by the body (14) For compensating for height variations between the clamp (12) and the element (18).

8 Claims, 4 Drawing Sheets

ADAPTER FOR A MAGNETIC CLAMP

CROSS-REFERENCE TO RELATED APPLICATIONS

The present application claims priority from Australian Provisional Patent 2004907162 filed on 16 Dec. 2004, the contents of which are incorporated herein by reference.

FIELD OF THE INVENTION

The invention relates to clamping of elements during a manufacturing process. The invention relates particularly, but not necessarily exclusively, to an adapter for a magnetic clamp.

BACKGROUND TO THE INVENTION

Manufacture of concrete slabs and structures is now commonly achieved by pre-casting techniques. Pre-cast manufacture of concrete slabs and structures is becoming the preferred method for many construction applications including industrial, commercial and retail applications.

Typically, pre-casting is performed on a steel bed. Steel beds can be constructed to have a surface with a relatively high level of precision. This allows concrete slabs and structures to be manufactured to an associated level of accuracy.

Edge or perimeter moulds are used to produce concrete slabs and structures of a certain shape. These moulds are commonly referred to as sideforms. Securing the sideforms in position on a steel bed may involve the use of magnetic clamps. However, in practice the surface of a steel bed is not completely uniform. Variations in height at certain regions of the bed may reach approximately 5 mm. For steel beds which are recognised to be of a relatively high quality, variations of approximately 3 mm between the high and low points are generally present. Such height variation can reduce the holding force a magnetic clamp exerts on a sideform, or cause the sideform to be supported in a position that is not perpendicular to the bed.

SUMMARY OF THE INVENTION

According to a first aspect of the invention, there is provided an adapter for a magnetic clamp, the adapter including:

- a body having an element engaging portion for engaging an element to be supported in position by the magnetic clamp; and
- a height compensation mechanism carried by the body for compensating for height variations between the magnetic clamp and the element.

The height compensation mechanism may include a resiliently flexible component.

The resiliently flexible component may define a bearing member which, in use, bears on a seat of the element.

The resiliently flexible component may be integrally formed with the body as a one-piece unit.

The resiliently flexible component may be an interrupted component comprising a number of independent portions.

The adapter may further include an urging means which acts on the resiliently flexible component to return the resiliently flexible component to a rest position. The urging means may be an elastomeric member. Instead, the urging means may be in the form of a spring such as a compression spring or a leaf spring. In another embodiment, the urging means may be a threaded arrangement.

The body may define mounting formations for releasably mounting the body to the clamp. Securing elements may co-operate with the mounting formations to secure the body to the clamp.

According to a second aspect of the invention, there is provided an adapter for a magnetic clamp, the adapter including:

- a body having an element engaging portion for engaging an element to be supported in position by the magnetic clamp; and
- a height compensation mechanism carried by the body for compensating for height variations of a work surface on which the magnetic clamp and the element rest.

BRIEF DESCRIPTION OF THE DRAWINGS

An embodiment of the invention is now described by way of example with reference to the accompanying diagrammatic drawings in which.

DETAILED DESCRIPTION OF THE EXEMPLARY EMBODIMENT

Figure 5:
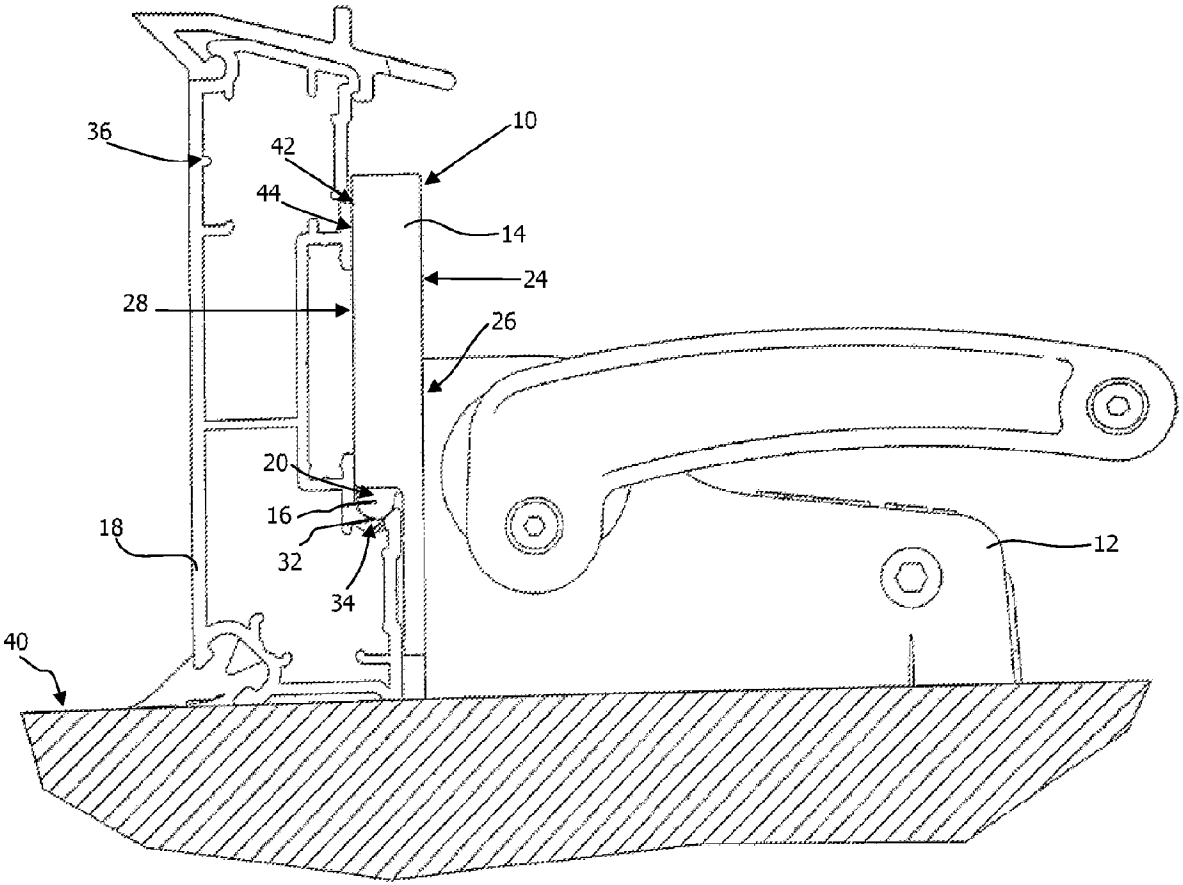
FIG. 5 shows a schematic side view of the adapter, in use, attached to the magnetic clamp.
Figure 6:
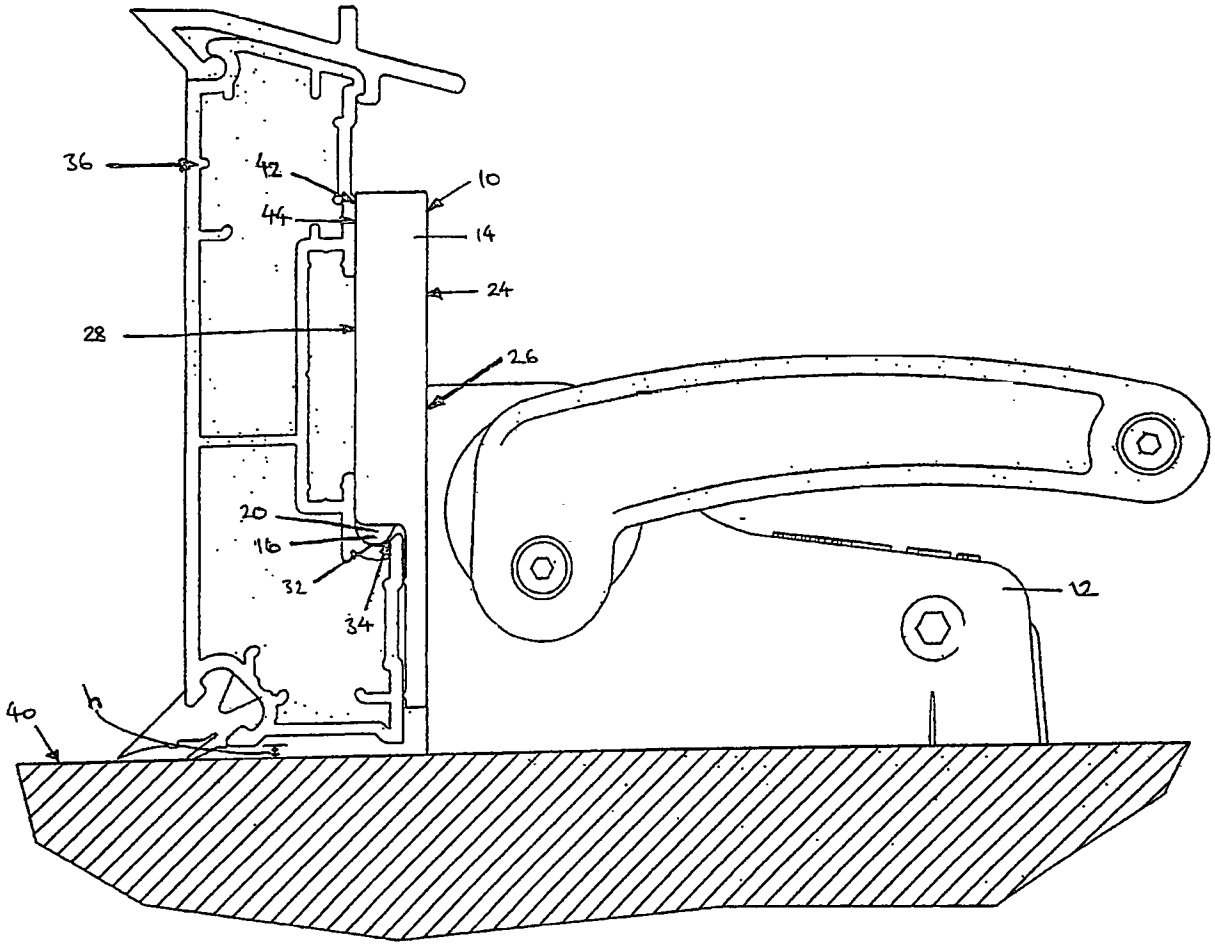
FIG. 6 shows a schematic side view of the adapter, also in use.

In the drawings, reference numeral 10 generally designates an exemplary embodiment of an adapter for a magnetic clamp 12 (FIGS. 5 and 6). The adapter 10 includes a body 14 having an element engaging portion 16 for engaging an element 18 to be supported in position by the magnetic clamp 12. The adapter 10 also includes a height compensation mechanism 20 carried by the body 14 for compensating for height variations between the magnetic clamp 12 and the element 18.

Figure 1:
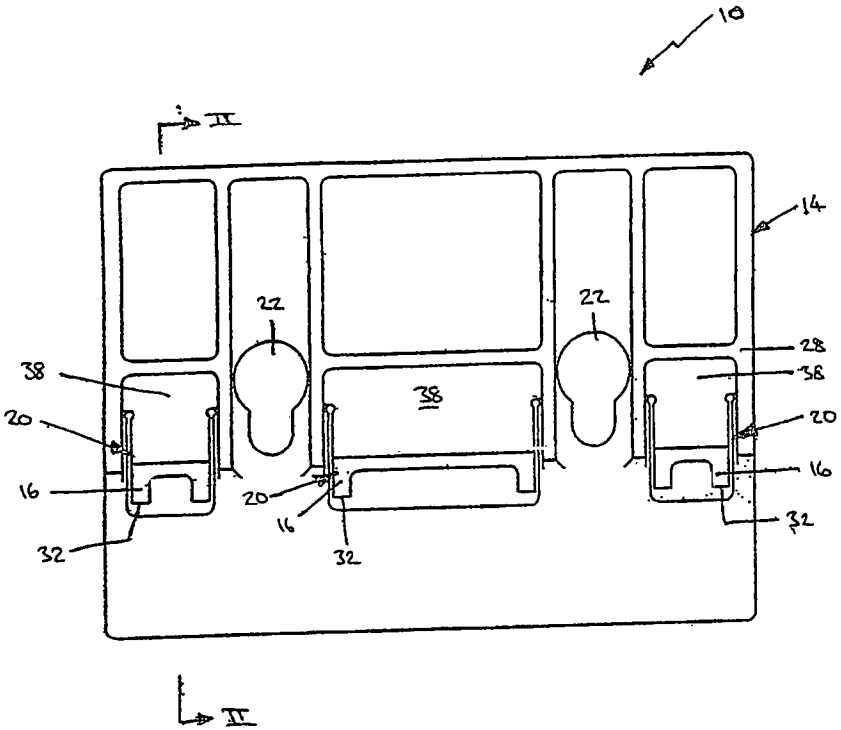
FIG. 1 shows a front view of an adapter, in accordance with an embodiment of the invention, for a magnetic clamp, in a rest condition.

The body 14 is mountable to an end face 26 (FIG. 5) of the clamp 12 by fasteners (not shown) positioned through mounting formations 22 (FIG. 1). The adapter 10 is mounted to the clamp 12 such that a first face 24 of the adapter 10 is substantially flush with an end face 26 of the clamp 12. In use, an opposed second face of the adapter 10 acts as a guide 28 which will be described in greater detail below.

The height compensation mechanism 20 is carried by the body 14. The height compensation mechanism 20 includes the element engaging portion 16 in the form of a resiliently flexible component 30. The embodiment of the adapter 10 shown in the drawings includes a height compensation mechanism 20 having three independent element engaging portions 16. Each element engaging portion 16 defines a bearing surface 32 for engaging a seat 234 (FIG. 5) of the element 18 which is to be clamped in a desired position. The element 18 is in the form of a sideform 36. In use, the element engaging portions 16 act like a spring to compensate for height variations between the clamp 12 and the sideform 36. In another embodiment, the height compensation mechanism 20 may be a threaded arrangement. The threaded arrangement may include a threaded member which bears against the resiliently flexible component 20. The threaded member may be arranged so that at least a portion of the threaded member is external to the body 14 to allow manual adjustment of the height compensation mechanism 20.

Figure 2:
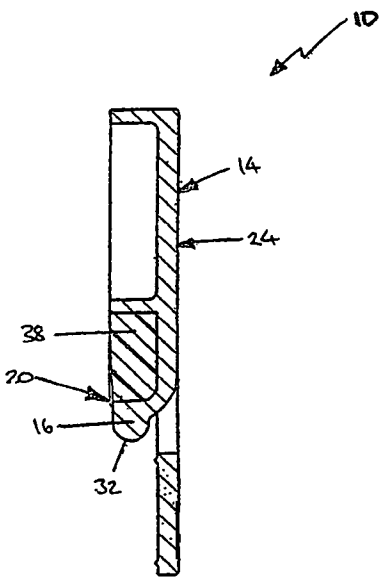
FIG. 2 shows a sectional side view of the adapter taken along line II-II in FIG. 1.

The adapter 10 also includes an urging means, in the form of a rubber insert 38, associated with, and acting on, each element engaging portion 16 to return the associated element engaging portions 16 to their rest positions as shown in FIGS. 1, 2 and 5. In another embodiment, the urging means may be a compression spring or a leaf spring.

In use, the adapter 10 is releasably secured to the clamp 12 as described above. The sideform 36 is placed on a work surface 40 (FIG. 5). In one application, the work surface 40 is a surface of a steel bed (not shown) and the sideform 36 is used for moulding precast concrete slabs and structures. Once the sideform 36 is in the required orientation, the clamp 12 is positioned such that the guide 28 makes contact with regions 42 of an operatively rear surface 44 of the sideform 36. To position the clamp 12 in its operative position, the clamp 12 is slid in the plane of the guide 28 relative to the sideform 36 until the clamp 12 makes contact with the work surface 40. The magnetic force of the clamp 12 acts to hold the bearing surface 32 in the seat 34 of the sideform 36 and holds the sideform 36 in the required orientation.

FIG. 5 shows the clamp 12 and the sideform 36 resting on a level work surface 40. In this case, the adapter 10 is not required to compensate for height variations.

Figure 4:
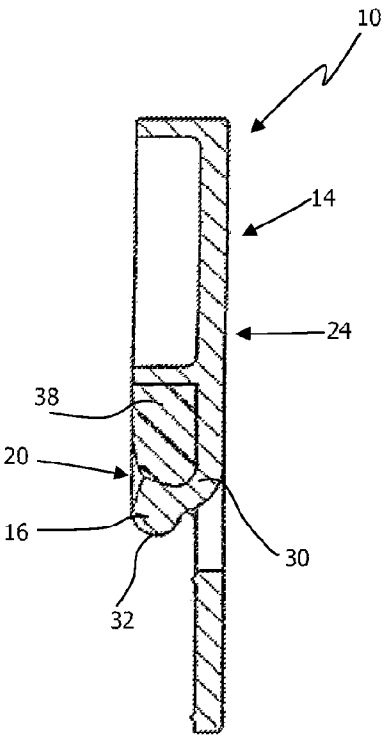
FIG. 4 shows a sectional side view of the adapter taken along line IV-IV in FIG. 3.
Figure 3:
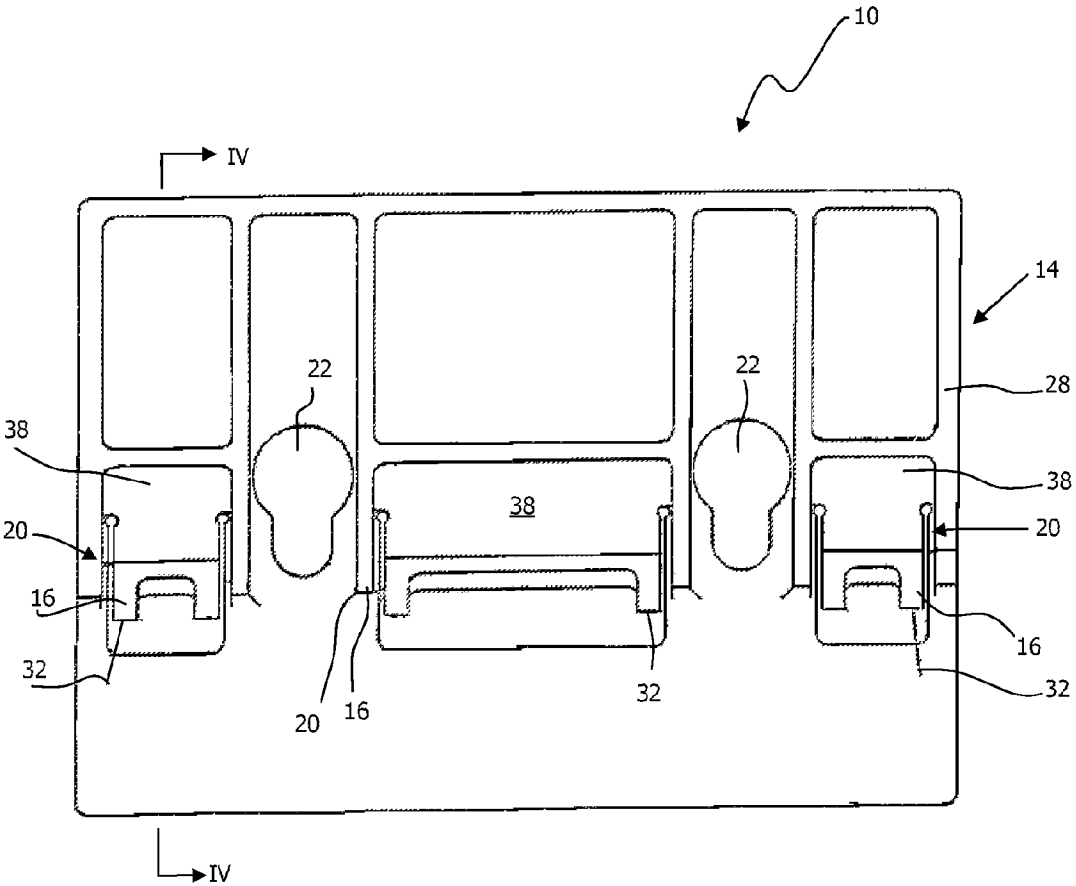
FIG. 3 shows a front view of the adapter in a height compensating condition.

FIG. 6 shows a situation where the work surface 40 is not level. In this case, the clamp 12 rests below the sideform 36 by an amount 'h'. To compensate for this height difference 'h', the element engaging portions 16, in response to the reactive force acting on the bearing surface 32, is displaced relative to the body 14. FIGS. 3 and 4 also show the element engaging portions 16 in their displaced positions.

The displacement of the element engaging portions 16 maintains the magnetic contact between the clamp 12 and the work surface 40.

After use, the clamp 12 is removed from the work surface 40 and the element engaging portions 16 return to their rest position. The return of the element engaging portion 16 to the rest position is aided by the elastic properties of the rubber insert 38.

It is an advantage of at least a preferred embodiment of the adapter 10 to provide compensation for variations in height between the clamp 12 and the sideform 36. It is a further advantage of the invention that by including a height compensation mechanism 20, the adapter 10 provides for more reliable and improved operation of the clamp 12.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. An adapter for a magnetic clamp for supporting a concrete sideform in position on a casting surface, the adapter including:

a body mountable to the magnetic clamp with a first face of the adapter in abutment against a surface of the magnetic clamp, the body having an aperture for coupling the body to the magnetic clamp, the aperture being in the form of a slotted hole to lock the adapter in position with upward movement of the adapter along said surface of the magnetic clamp;

a sideform engaging portion for engaging a sideform to be supported in position by the magnetic clamp, the sideform engaging portion being movable relative to the body; and a height compensation mechanism including an urging means arranged to urge the sideform engaging portion relative to the body for compensating for height variations between the magnetic clamp and the sideform when the magnetic clamp is in magnetic contact with the casting surface to anchor the sideform in position on the casting surface, wherein the adapter has a second face for abutting against a rear surface of the sideform, the second face being opposed to the first face of the adapter to accommodate the adapter being sandwiched between the sideform and the magnetic clamp in use, and the height compensation mechanism being arranged to allow movement of the sideform engaging portion parallel to a plane of the second face to accommodate said height variation between the magnetic clamp and the sideform in a direction perpendicular to the casting surface to thereby maintain magnetic tact between the magnetic clamp and the casting surface.

2. The adapter of claim 1 wherein the urging means includes a resiliently flexible component.

3. The adapter of claim 2 wherein the sideform engaging portion defines a bearing member which, in use, bears on a seat of the sideform.

4. The adapter of claim 2 or claim 3 in which the resiliently flexible component and the body are integrally formed as a one-piece unit.

5. The adapter of any one of claims 2 to 4 in which the resiliently flexible component is an interrupted component comprising a number of independent portions.

6. The adapter of any one of claims 2 to 5 wherein the urging means acts on the sideform engaging portion to return the sideform engaging portion to a rest position.

7. The adapter of claim 6 in which the urging means is an elastomeric member.

8. The adapter of any one of the preceding claims in which the body defines mounting formations for releasably mounting the body to the clamp.

* * * * *

UNITED STATES PATENT AND TRADEMARK OFFICE

CERTIFICATE OF CORRECTION

PATENT NO. : 8,690,139 B2
APPLICATION NO. : 11/721025
DATED : April 8, 2014
INVENTOR(S) : Sladojevic et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1754 days.

Signed and Sealed this
Eleventh Day of August, 2015

Michelle K. Lee

Michelle K. Lee
*Director of the United States Patent and Trademark Office*